US005505046A

United States Patent [19]

Nelson et al.

[11] Patent Number: 5,505,046

[45] Date of Patent: Apr. 9, 1996

[54] CONTROL SYSTEM FOR THERMOELECTRIC REFRIGERATOR

[75] Inventors: John L. Nelson, Garland; Lance Criscuolo, Dallas; Michael D. Gilley, Rowlett; Brian V. Park, Austin, all of Tex.

[73] Assignees: Marlow Industrie, Inc., Dallas; Oceaneering International, Inc., Houston, both of Tex.

[21] Appl. No.: 580,888

[22] Filed: Jan. 12, 1994

[51] Int. Cl.[6] ..... F25B 21/02

[52] U.S. Cl. ..... 62/3.6; 62/3.7; 62/428; 62/443; 62/452; 165/18

[58] Field of Search ..... 62/3.7, 3.6, 3.64, 62/430, 443, 452, 404, 407, 414, 419, 428; 165/18

[56] References Cited

U.S. PATENT DOCUMENTS

| | | | |
|---|---|---|---|
| 1,964,795 | 7/1934 | Frary | 428/76 |
| 2,275,365 | 3/1942 | Hintze | 312/406 |
| 2,768,046 | 10/1956 | Evans | 312/406 |
| 2,779,066 | 1/1957 | Gaugler et al. | 428/69 |
| 2,837,899 | 6/1958 | Lindenblad | 62/1 |
| 2,872,788 | 2/1959 | Lindenblad | 62/3 |
| 2,932,953 | 4/1960 | Becket et al. | 62/3 |
| 3,078,682 | 2/1963 | Gould | 62/3 |
| 3,177,670 | 4/1965 | Boehmer et al. | 62/3 |
| 3,177,671 | 4/1965 | Stambaugh | 62/3 |
| 3,240,029 | 3/1966 | Wurtz | 312/401 |
| 3,280,573 | 10/1966 | Brown et al. | 62/3 |
| 3,732,702 | 5/1973 | Desch | 62/3 |
| 3,821,881 | 7/1974 | Harkias | 62/3 |
| 3,823,567 | 7/1974 | Corini | 62/3 |
| 4,007,600 | 2/1977 | Simms | 62/3.6 |
| 4,036,324 | 8/1977 | Lindenschmidt | 312/406 |
| 4,088,183 | 5/1978 | Anzai et al. | 165/104 |
| 4,146,213 | 3/1979 | Regelin | 266/197 |

(List continued on next page.)

FOREIGN PATENT DOCUMENTS

| | | | |
|---|---|---|---|
| 0242363 | 12/1962 | Australia | 312/406 |
| 627705 | 3/1992 | Australia . | |
| 1126180 | 6/1982 | Canada | B65D 3/22 |
| 0342165 | 11/1989 | European Pat. Off. | F25B 21/02 |
| 2432693 | of 1980 | France . | |
| 1125957 | 6/1960 | Germany . | |
| 1198837 | 8/1965 | Germany . | |
| 1401585 | 6/1970 | Germany | 312/406 |
| 2529801 | 2/1976 | Germany | 312/406 |
| 3503281 | 1/1985 | Germany | F25B 21/02 |
| 320580 | 1/1991 | Japan . | |
| 0671283 | 4/1952 | United Kingdom | 312/406 |
| 8101739 | 6/1981 | WIPO | F25B 21/02 |
| 8504948 | 11/1985 | WIPO | F25B 21/02 |
| WO9204301 | 3/1992 | WIPO | C04B 30/02 |

OTHER PUBLICATIONS

"The World's Most Thermally–Effiecient Cabinet, Using Environmental–Friendly Refrigeration Technology" by Marlow Industries, Inc., Feb., 1995.

*Popular Science,* Home Technology, "Freon–Free Fridge," p. 42, Apr. 1995.

"New Scientific Development in Refrigeration" *Electric & Gas Technology, Inc.*

*Primary Examiner*—John M. Sollecito

*Attorney, Agent, or Firm*—Baker & Botts

[57] ABSTRACT

Apparatus including a power supply (202) and control system is provided for maintaining the temperature within an enclosed structure (40) using thermoelectric devices (92). The apparatus may be particularly beneficial for use with a refrigerator (20) having superinsulation materials (46) and phase change materials (112) which cooperate with the thermoelectric device (92) to substantially enhance the overall operating efficiency of the refrigerator (20). The electrical power supply (202) and control system allows increasing the maximum power capability of the thermoelectric device (92) in response to increased heat loads within the refrigerator (20). The electrical power supply (202) and control system may also be used to monitor the performance of the cooling system (70) associated with the refrigerator (20).

10 Claims, 3 Drawing Sheets

U.S. PATENT DOCUMENTS

| | | | |
|---|---|---|---|
| 4,203,487 | 5/1980 | Gartner | 165/50 |
| 4,290,416 | 9/1981 | Maloney | 126/430 |
| 4,326,383 | 4/1982 | Reed et al. | 62/3 |
| 4,328,676 | 5/1982 | Reed | 62/3 |
| 4,346,562 | 8/1982 | Beitner | 62/3 |
| 4,383,414 | 5/1983 | Beitner | 62/3 |
| 4,467,611 | 8/1984 | Nelson et al. | 62/3 |
| 4,570,679 | 2/1986 | Schippl | 138/149 |
| 4,609,036 | 9/1986 | Schrader | 165/10 |
| 4,625,229 | 11/1986 | Maier | 357/81 |
| 4,627,242 | 12/1986 | Beitner | 62/3 |
| 4,637,222 | 1/1987 | Fujiwara | 62/244 |
| 4,644,753 | 2/1987 | Burke | 62/3 |
| 4,662,180 | 5/1987 | Menocal | 62/3 |
| 4,726,193 | 2/1988 | Burke et al. | 62/3 |
| 4,781,329 | 11/1988 | Tenny et al. | 239/305 |
| 4,838,911 | 6/1989 | Robertson et al. | 62/3.3 |
| 4,878,352 | 11/1989 | Weber et al. | 62/51.1 |
| 4,907,060 | 3/1990 | Nelson et al. | 357/72 |
| 4,922,822 | 5/1990 | Bierschenk et al. | 136/204 |
| 4,984,605 | 1/1991 | Schippl | 138/149 |
| 5,007,226 | 4/1991 | Nelson | 52/809 |
| 5,018,328 | 5/1991 | Cur et al. | 50/406 |
| 5,029,446 | 7/1991 | Suzuki | 62/3.6 |
| 5,064,476 | 11/1991 | Recine, Sr. | 136/201 |
| 5,082,335 | 1/1992 | Cur et al. | 312/401 |
| 5,090,981 | 2/1992 | Rusek, Jr. | 65/4.4 |
| 5,094,899 | 3/1992 | Rusek, Jr. | 428/69 |
| 5,157,893 | 10/1992 | Benson et al. | 52/792 |
| 5,168,339 | 12/1992 | Yokotani et al. | 257/64 |
| 5,171,372 | 12/1992 | Recine, Sr. | 136/203 |
| 5,209,069 | 5/1993 | Newman | 62/3.64 |
| 5,252,408 | 10/1993 | Bridges et al. | 428/621 |
| 5,291,746 | 3/1994 | Abbott | 62/89 |
| 5,315,830 | 5/1994 | Doke et al. | 62/3.2 |
| 5,330,816 | 7/1994 | Rusek, Jr. | 428/69 |
| 5,367,879 | 11/1994 | Doke et al. | 62/3.6 |

CONTROL SYSTEM FOR THERMOELECTRIC REFRIGERATOR

NOTICE

Portions of this invention were made with support of the United States Government under contract No. NAS8-5000 awarded by the National Aeronautics and Space Administration (NASA) and subcontract No. GY5509. The Government may have certain rights to the invention under the contract.

RELATED APPLICATIONS

This application is related to co-pending patent application Ser. No. 08/180,887 filed Jan. 12, 1994 (Attorney's Docket 017083.0126); co-pending patent application Ser. No. 08/180,879 filed Jan. 12,. 1994 (Attorney's Docket 017083.0127); patent application Ser. No. 08/180,456 filed Jan. 12, 1994 now U.S. Pat. No. 5,398,510 (Attorney's Docket 017083.0133; and co-pending patent application Ser. No. 08/409,214 filed Mar. 23, 1995 (Attorney's Docket 017083.0192).

TECHNICAL FIELD OF THE INVENTION

This invention relates to thermoelectric devices and more particularly to a thermoelectric refrigerator having enhanced insulation and energy storage capability.

BACKGROUND OF THE INVENTION

The basic theory and operation of thermoelectric devices has been developed for many years. Modern thermoelectric devices typically include an array of thermocouples which operate by using the Peltier effect. Thermoelectric devices are essentially small heat pumps which follow the laws of thermodynamics in the same manner as mechanical heat pumps, refrigerators, or any other apparatus used to transfer heat energy. The principal difference is that thermoelectric devices function with solid state electrical components (thermocouples) as compared to more traditional mechanical/fluid heating and cooling components.

When DC electrical power is applied to a thermoelectric device having an array of thermocouples, heat is absorbed on the cold side of the thermocouples and passes through the thermocouples and is dissipated on the hot side of the thermocouples. A heat sink (sometimes referred to as the "hot sink") is preferably attached to the hot side of the thermoelectric device to aid in dissipating heat from the thermocouples to the adjacent environment. In a similar manner a heat sink (sometimes referred to as a "cold sink") is often attached to the cold side of the thermoelectric device to aid in removing heat from the adjacent environment. Thermoelectric devices are sometimes referred to as thermoelectric coolers. However, since they are a type of heat pump, thermoelectric devices can function as either a cooler or a heater.

There are a wide variety of containers and enclosed structures which are designed to be maintained within a selected temperature range. Examples of such containers and enclosed structures include, but are not limited to, refrigerators, picnic coolers, cabinets containing sensitive electronic equipment, and organ transplant containers. The use of thermoelectric devices which operate on a DC voltage system are well known to maintain desired operating temperatures in refrigerators and portable coolers. An example of a container having a thermoelectric cooler is shown in U.S. Pat. No. 4,726,193 entitled Temperature Controlled Picnic Box. Examples of refrigerators which function with a thermoelectric device are shown in U.S. Pat. No. 2,837,899 entitled Thermoelectric Refrigerator; U. S. Pat. No. 3,177,670 entitled Thermoelectric Refrigerator and U.S. Pat. No. 3,280,573 entitled Refrigerator—Package Arrangement. U.S. Pat. No. 5,168,339, entitled Thermoelectric Semiconductor Having A Porous Structure Deaerated in a Vacuum and Thermoelectric Panel Using P-Type and N-Type Thermoelectric Semiconductors, discloses an electronic refrigeration panel. These patents are incorporated by reference in their entirety for all purposes within this application.

Conventional refrigerators typically consist of an insulated enclosure with a centralized cooling system based on the vapor compression cycle of fluorinated hydrocarbons (FREON®) or other types of hydrocarbons. The cooling system usually has greater cooling capacity than the actual heat load which results in the cooling system acting intermittently in a binary duty cycle—either on or off. This binary duty cycle results in temperature variations as the refrigerator warms up while the compressor is off and cools down when the compressor is running. Thus the temperature in a typical refrigerator is not steady but cycles between an upper limit and a lower limit. This compressor cycling may reduce the operating efficiency of the associated cooling system.

Presently available cooling systems frequently include an air/evaporator interface which requires a relatively high air flow rate to obtain the best cooling efficiency and to prevent frost or ice from forming on the evaporator. This air flow rate is often in excess of the air velocities required to cool the interior of the refrigerator and results in further system inefficiencies. Finally, vapor compression cooling systems frequently use CFCs (chloro-fluorocarbons) such as FREON® as the working fluid. The negative effects of CFCs on the environment are well known and there exists both national and international regulations to ban the use of such CFCs. Other fluorocarbons such as HCFCs and HFCs have their own limitations and problems for use in refrigeration systems.

SUMMARY OF THE INVENTION

In accordance with the present invention, disadvantages and problems associated with previous thermoelectric refrigerators used to maintain selected temperatures within such refrigerators have been substantially reduced or eliminated.

The present invention includes an apparatus for controlling the temperature within a refrigerator or other enclosed structures. The apparatus includes a thermoelectric device with a first heat sink disposed on one side of the device and a second heat sink disposed on the other side of the device. The apparatus also includes an electrical motor mounted on the enclosed structure adjacent to the thermoelectric device and a rotating shaft extending through the electric motor with an impeller mounted on one end of the rotating shaft for providing an air flow. A first magnet is mounted on the opposite end of the rotating shaft with the motor and impeller mounted on the exterior of the enclosed structure. The apparatus also includes a second impeller for providing an air flow mounted on the interior of the enclosed structure with a second magnet attached thereto and disposed adjacent to the first magnet with a portion of the enclosed structure disposed between the first magnet and the second magnet.

The second impeller is driven by the motor, first magnet and second magnet.

One aspect of the present apparatus includes the first impeller located adjacent to the first heat sink and the second impeller located adjacent to the second heat sink.

Another aspect of the present apparatus comprises a thermoelectric device with a plurality of thermoelectric elements arranged in a first group and a second group. The thermoelectric elements of the first group are electrically connected in series with each other and thermoelectric elements of the second group are connected electrically in series with each other. Additionally, the two groups of thermoelectric elements may be electrically connected in series or parallel by a switch depending on the cooling needs of the apparatus.

The present invention provides a technical advantage of providing a control system for monitoring the performance and operation of a thermoelectric refrigerator.

The present invention provides an additional technical advantage of a thermoelectric refrigerator with low and high power operating modes. The present invention provides a unit which can act as a refrigerator or freezer simply by adjusting the set temperature.

Another technical advantage of the present invention is that it can provide refrigeration without using harmful CFCs or other fluorocarbons. The present invention also eliminates the need for high air flow rates typically required to provide efficient refrigeration in currently available refrigerators.

Also, the present system provides a technical advantage of using readily available components. Therefore the present system has relative low cost over more traditional mechanical/fluid heating and cooling component systems.

BRIEF DESCRIPTION OF THE DRAWINGS

For a more complete understanding of the present invention, and the advantages thereof, reference is now made to the following written description taken in conjunction with the accompanying drawings, in which.

Figure 1:
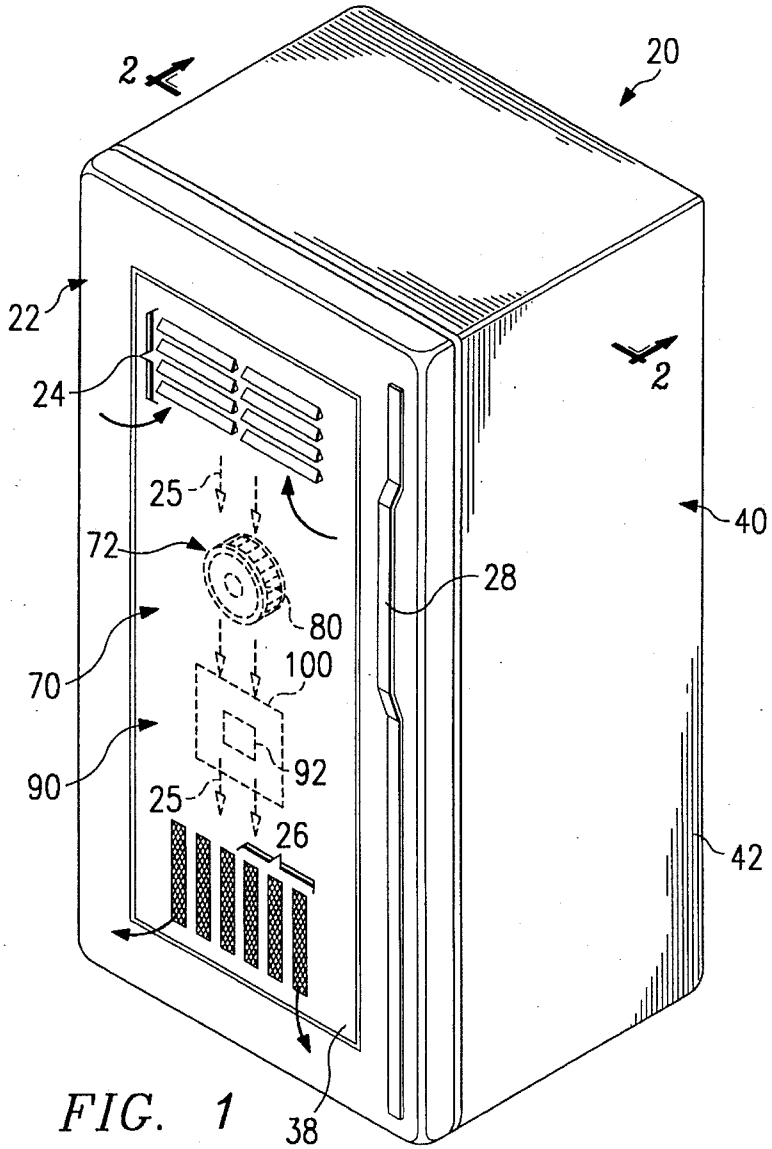
FIG. 1 is an isometric drawing of a refrigerator or enclosed structure having a thermoelectric assembly, superinsulation panels, an electrical power supply, and a control system incorporating an embodiment of the present invention.
Figure 6:
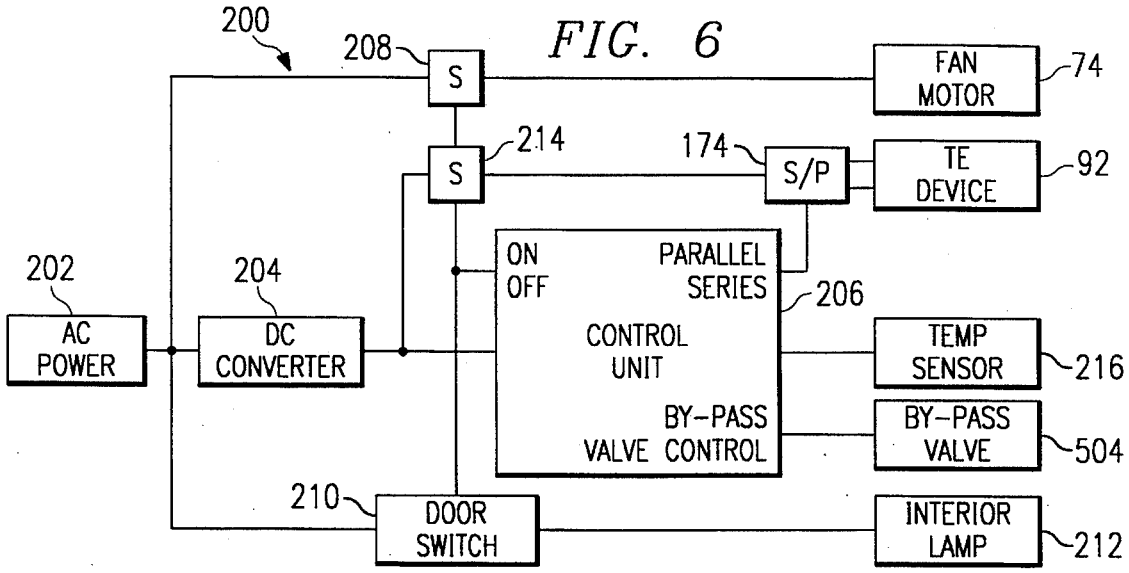
Figure 7:
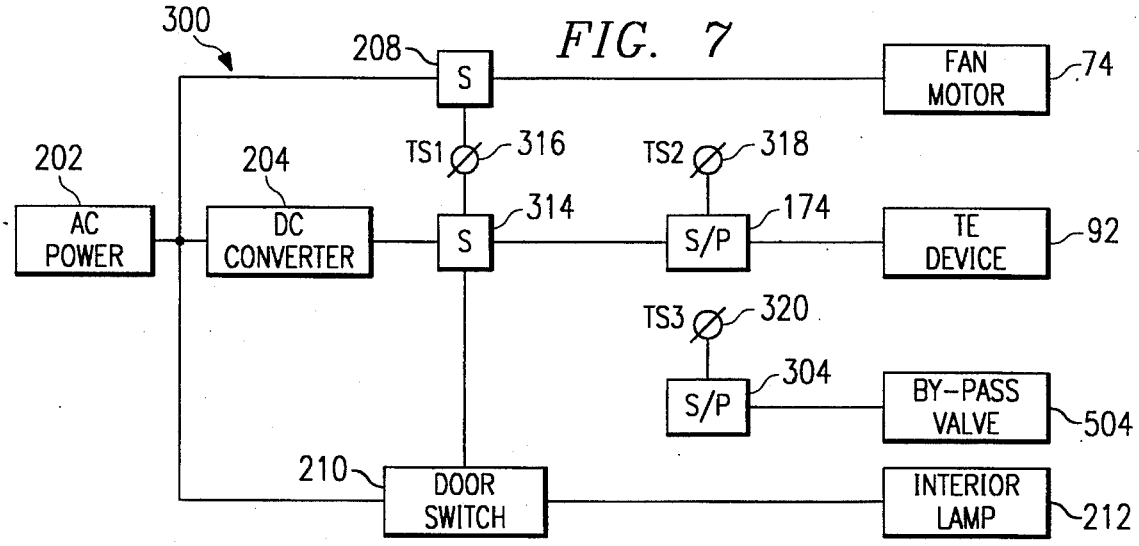
Figure 5:
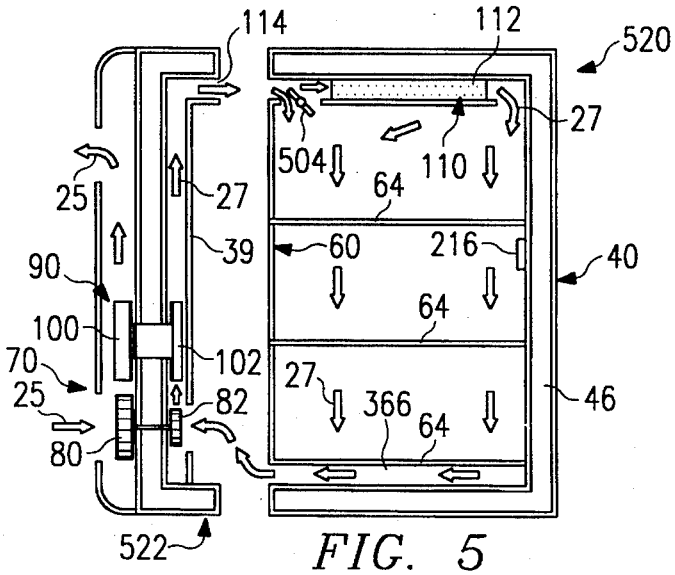
Figure 8:
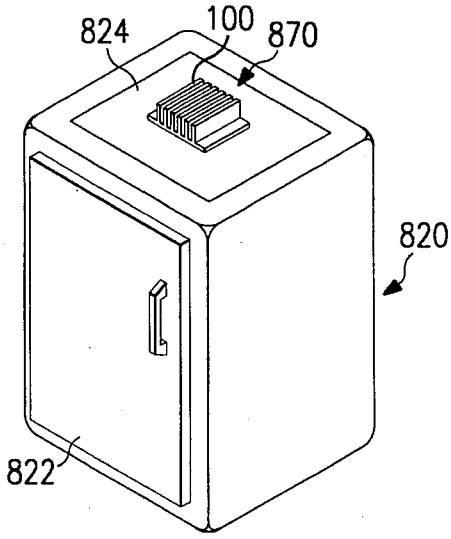

FIGS. *4a*–*4b* are schematic drawings showing an electrical circuit for use with a thermoelectric device incorporating an embodiment of the present invention suitable for use with the refrigerator shown in FIG. 1;

FIG. 5 is a drawing in section with portions broken away showing an additional embodiment of the present invention including a thermal energy storage container;

FIG. 6 is a block diagram showing an electrical power supply and control system satisfactory for use with an embodiment of the present invention;

FIG. 7 is a schematic block diagram showing an electrical power supply and control system suitable for use with another embodiment of the present invention; and FIG. 8 is an isometric drawing of a refrigerator or enclosed structure having superinsulation materials and a thermoelectric assembly incorporating another embodiment of the present invention.

DETAILED DESCRIPTION OF THE INVENTION

Preferred embodiments of the present invention and its advantages are best understood by referring to FIGS. 1 through 8 of the drawings, like numerals being used for like and corresponding parts of the various drawings.

Figure 2:
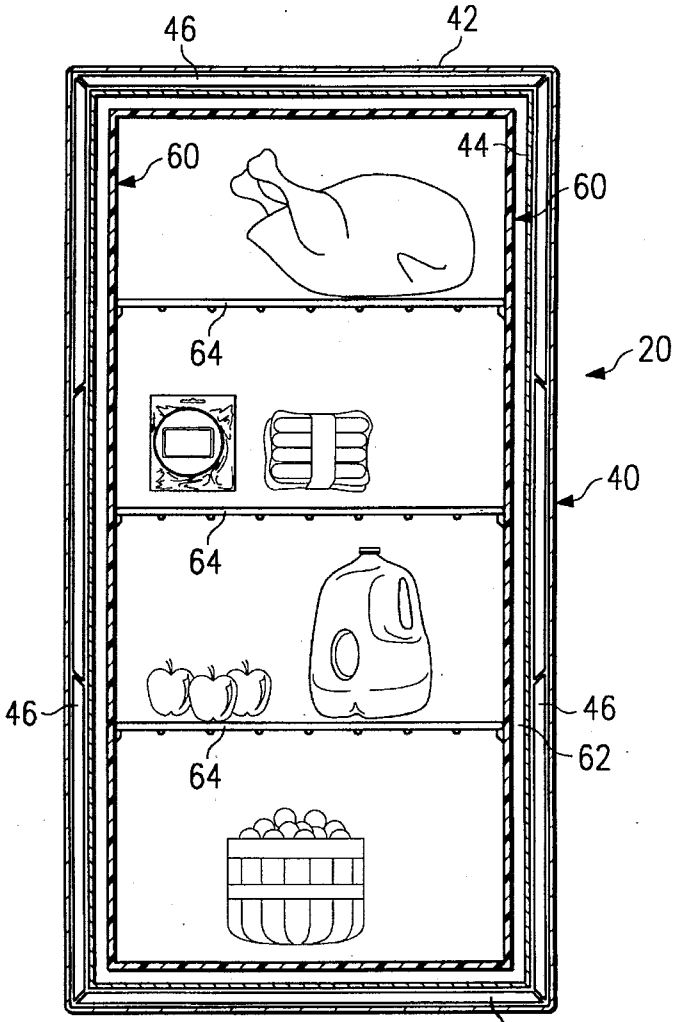
FIG. 2 is a drawing in section with portions broken away taken along line 2—2 of FIG. 1 showing the use of superinsulation panels, and an internal cabinet associated with the refrigerator of FIG. 1.

FIGS. 1 and 2 show refrigerator 20 incorporating an embodiment of the present invention. The principal components of refrigerator 20 include enclosed structure 40 having door assembly 22 with cooling system 70 mounted thereon. Door assembly 22 provides access to the interior of enclosed structure 40. Cooling system 70 mounted on door assembly 22 includes air circulating means 72 and thermoelectric assembly 90. Door assembly 22 preferably includes a plurality of air inlet openings 24 and a plurality of air outlet openings 26. Air flow from inlet openings 24 to outlet openings 26 is indicated generally by arrows 25. Handle 28 and hinges (not explicitly shown) are also provided for use in opening and closing door assembly 22. Refrigerator 20 may function to maintain the temperature in enclosed structure 40 in a selected temperature range, which may be above or below zero degrees Celsius.

As best shown in FIG. 2, enclosed structure 40 preferably includes outer liner 42 and inner liner 44 with a plurality of superinsulation panels 46 disposed therebetween. As will be explained later in more detail, superinsulation panels 46 are preferably included as part of door assembly 22. Also, superinsulation materials other than panels 46 may be satisfactorily used within the concepts of the present invention. The benefits of the present invention are best achieved by using superinsulating materials as described below.

Insulation performance is often measured by the use of "R" values, where R is a thermal resistivity in $HrFt^2$ F/Btu. Higher R-values indicate better insulating performance. R-value/inch is frequently used to compare the thermal performance of different insulating materials. For example, fiberglass may have R-value/inch of approximately 3.2 $HrFt^2$ F/Btu, and styrene foam may have an R-value/inch of approximately 5 $HrFt^2$ F/Btu. The benefits of the present invention are best achieved by using insulating materials with an R-value per inch greater than approximately 20 $HrFt^2$ F/Btu (R20/inch. Internal cabinet 60 is preferably disposed within the interior of enclosed structure 40 to partially define air flow path 62 between the exterior of cabinet 60 and interior of inner liner 44. Air flow path 62 may be used to provide an "air curtain" which further enhances the overall performance of cooling system 70 and refrigerator 20. The benefits of providing such an air curtain will be described later in more detail. A plurality of shelves 64 are preferably provided within internal cabinet 60 for use in storing food or other perishable items within refrigerator 20. The number and location of shelves 64 may be varied depending upon the function and intended uses of refrigerator 20. For some applications, one or more doors may be included as part of internal cabinet 60.

For purposes of this patent application, the term "superinsulation panel" is used to refer to insulating material having an R-value per inch greater than twenty (R20/inch). Various types of superinsulation panels may be satisfactorily used with the present invention. A preferred superinsulation panel is set forth in pending U.S. patent application Ser. No. 07/993,883, filed Dec. 23, 1992. This application is incorporated by reference for all purposes within this application. Examples of such superinsulation panels which have a high R-value are described in U.S. Pat. No. 5,090,981, entitled Method for Making High R Superinsulation Panel, and U.S. Pat. No. 5,094,899, entitled High R Superinsulation Panel. Both of these patents are incorporated by reference in their entirety for all purposes within this application. Such superinsulation panels are available from Owens-Corning Fiberglas Corporation located in Toledo, Ohio. Owens-Corning uses the trademark "AURA" with respect to such superinsulation panels.

Figure 3:
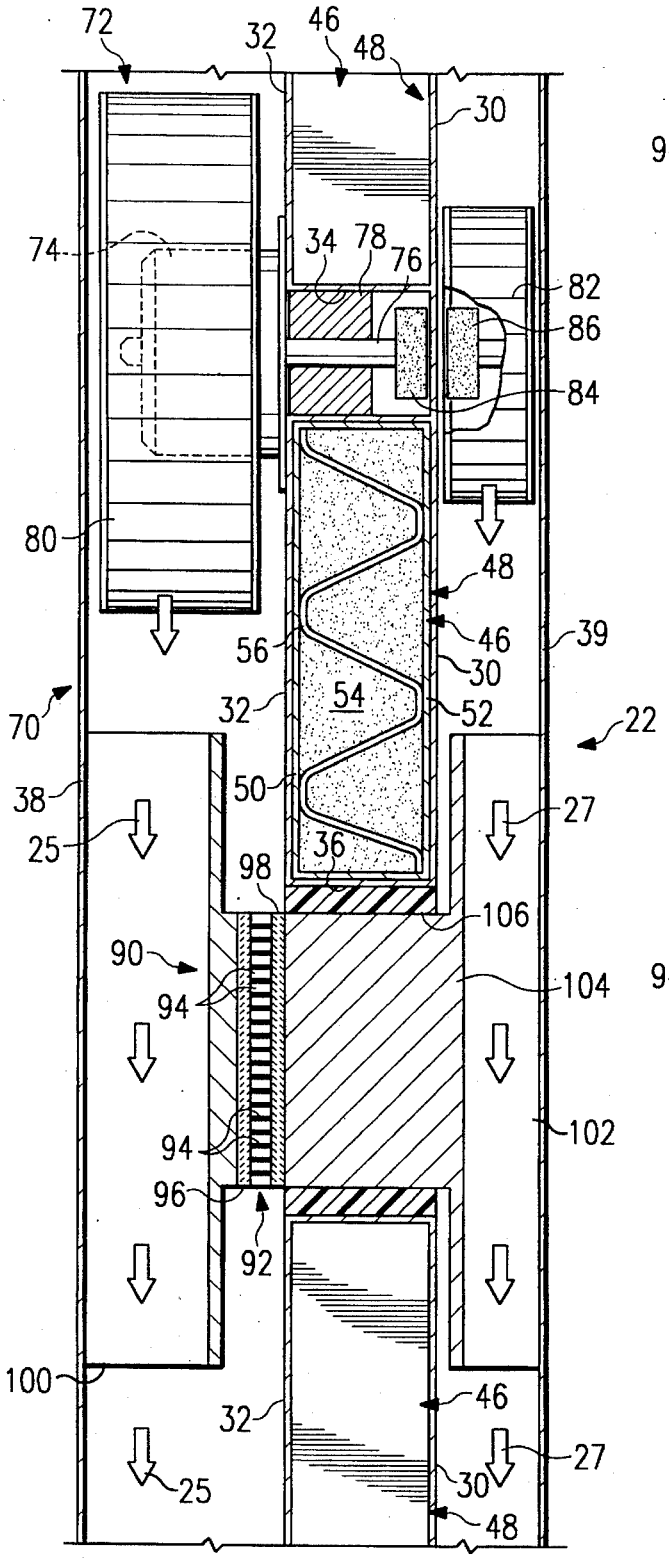
FIG. 3 is a drawing partially in elevation and partially in section with portions broken away showing a portion of the door assembly of the refrigerator of FIG. 1 with a cooling system incorporating an embodiment of the present invention.

Superinsulation panels 46 shown in FIGS. 2 and 3 have a generally rectangular configuration. However, superinsulation panels having square, oval, circular, or any other geometric configuration may be satisfactorily used within the concepts of the present invention. Superinsulation panels 46 preferably include a sealed envelope 48 having a first wall 50 and a second wall 52. Envelope 48 is generally constructed of a gas impervious material. Various types of filler material or insulating material 54 and supporting structures 56 may be disposed within envelope 48 between walls 50 and 52. Envelope 48 is typically sealed around the edges of walls 50 and 52 to maintain the desired vacuum within envelope 48. For some applications, superinsulation panels 46 may be evacuated to a vacuum between $10^{-4}$ Torr and 10 Torr.

U.S. Pat. Nos. 5,090,981 and 5,094,899 teach the use of mineral fiber board and particulate matter packed in the interstices of the fiberboard to perform the functions of filler material 54 and supporting structure 56. U.S. Pat. No. 5,157,893, entitled Compact Vacuum Insulation, teaches the use of spherically shaped glass or ceramic beads which function as filler material 54 and continuous sheets of metal which function as supporting structure 56. U.S. Pat. No. 5,252,408, entitled Vacuum Insulated Panel and Method of Forming a Vacuum Insulated Panel, teaches the use of a compressed block of particulate charcoal, activated carbon black, silica gel or other appropriate mixtures to perform the function of filler material 54 and supporting structure 56. U.S. Pat. No. 5,082,335, entitled Vacuum Insulation System for Insulating Refrigerator Cabinets, teaches the use of a vacuum insulation panel having multiple sealed compartments containing microporous filler insulation material. Each of the above-referenced patents are incorporated by reference in their entirety for all purposes within this application.

During the assembly of enclosed structure 40, superinsulation panels 46 are preferably positioned between outer liner 42 and inner liner 44. In a similar manner, during the manufacture of door assembly 22, superinsulation panels 46 are preferably disposed between an inner liner 30 and an outer liner 32 (See FIG. 3). As will be described later in more detail, openings 34 and 36 are preferably provided through liners 30 and 32 for use in mounting cooling system 70 with door assembly 22.

FIG. 3 depicts an embodiment of cooling system 70. As previously noted, the principal components of cooling system 70 include air circulating means 72 and thermoelectric assembly 90. As shown in FIG. 3, the various components which comprise cooling system 70 are typically mounted on either the exterior portion or the interior portion of door assembly 22 with superinsulation panels 46 disposed therebetween. Exterior cover 38 is preferably placed over the exterior portion of door assembly 22 and interior cover 39 placed over the interior portion of door assembly 22. As will be explained later in more detail, covers 38 and 39 establish a portion of the desired air flow path within cooling system 70.

Air circulating means 72 preferably includes electrical fan motor 74 mounted on the exterior of door assembly 22 adjacent to thermoelectric assembly 90. Rotating shaft 76 preferably extends through fan motor 74 and opening 34 provided in liner 32. Bearing and insulating means 78 are preferably disposed between opening 34 to support rotating shaft 76. Impeller 80 is preferably secured to rotating shaft 76 on the exterior portion of door assembly 22.

It is important to note that opening 34 is formed only in liner 32 and does not extend through liner 30. Magnet 84 is preferably disposed on the other end of rotating shaft 76 within opening 34. Impeller 82 has its magnetic 86 preferably mounted on the interior portion of door assembly 22 adjacent to magnet 84 with inner liner 30 disposed therebetween. Thus, liner 30 prevents any air flow and heat transfer through opening 34. Magnets 84 and 86 cooperate with each other such that rotation of shaft 76 results in rotation of impeller 82. Various types of propellers and/or fan blades can be attached to rotating shaft 76 in place of impellers 80 and 82 without departing from the inventive concepts of the present invention. Also, various mechanisms other than magnets 84 and 86 may be satisfactorily used to allow shaft 76 to drive impeller 82.

Thermoelectric assembly 90 includes thermoelectric device 92 with first heat sink 100 and second heat sink 102 disposed on opposite sides thereof. Thermoelectric device 92 preferably includes a plurality of thermocouples or thermoelectric elements 94 disposed between thermally conductive plates 96 and 98. For some applications, plates 96 and 98 may be formed from ceramic and/or composite materials as desired. Thermoelectric elements 94 may be selected from materials such as bismuth telluride to provide an array of P-N junctions with the desired thermoelectric characteristics to allow thermoelectric device 92 to function as a heat pump.

For one embodiment of the present invention, thermoelectric elements 94 may be connected electrically in series and thermally in parallel. An electrical conductor or electrical power cord (not shown) may be provided to supply DC electrical energy from a power supply to thermoelectric device 92. The power supply can be a battery, DC power generator, AC/DC converter, or any other appropriate source of DC electricity. When DC electricity is supplied to thermoelectric device 92, heat is absorbed on the cold side represented by plate 98, passes through thermoelectric elements or thermocouples 94, and is dissipated on the hot side at plate 96.

An alternative configuration for the connection of thermoelectric elements 94 within an electrical circuit will be later described in more detail. Also various electrical power supply and control systems associated with thermoelectric assembly 90 will be described later in more detail.

The efficiency of thermoelectric device 92 is substantially improved by attaching first heat sink 100 to hot plate 96 and second heat sink 102 to cold plate 98. Various types of bonding techniques and mounting procedures may be used to secure first heat sink 100 and second heat sink 102 to thermoelectric device 92. Second heat sink 102 preferably includes cold finger 104 which may be positioned within opening 36. Various types of sealing means 106, such as elastomeric material, may be disposed between the exterior of cold finger 104 and the interior of opening 36 to prevent air flow. Preventing air flow minimizes the undesirable transfer of thermal energy between the exterior of door assembly 22 to the interior of enclosed structure 40 when door assembly 22 is closed against structure 40.

Cold finger 104 cooperates with opening 36 and seal means 106 to provide a portion of a means for mounting thermoelectric assembly 90 on door assembly 22. Cold finger 104 may be formed as an integral part of second heat sink 102 (See FIG. 5.) Alternatively, cold finger 104 may be formed as a separate component and bonded with heat sink 102 and conductive plate 98.

Heat sinks 100 and 102 are shown as fin-type heat exchangers which may be extruded as a single unit from appropriate material such as aluminum or copper. Heat sinks 100 and 102 can be manufactured from other types of material having the desired thermal conductivity and strength characteristics. In addition, other heat exchanger designs such as pin-fin, slotted-fin or fin-welded heat sinks can be used in place of the single unit extruded heat sinks 100 and 102 shown in FIG. 3.

When DC electrical power is supplied to thermoelectric device 92 of FIG. 3, heat energy will flow from the interior of refrigerator 20 through heat sink 102 and cold finger 104 to conductive plate 98. The heat energy at conductive plate 98 is transferred by thermoelectric elements 94 by the Peltier effect to conductive plate 96. The transferred heat is dissipated or diffused to the exterior of refrigerator 20 by first heat sink 100.

Air circulating means 72 is positioned adjacent to heat sink 100 and/or heat sink 102 to assist with the circulation of air and the transfer of heat energy from the interior of refrigerator 20 to the exterior of refrigerator 20 through thermoelectric assembly 90. Air circulated by impeller 80 is indicated generally by arrow 25, and air circulated by impeller 82 is indicated generally by arrow 27. U.S. Pat. No. 4,726,193 entitled Temperature Controlled Picnic Box shows an example of air circulating means used with a thermoelectric device. U.S. Pat. No. 4,726,193 is incorporated by reference in its entirety for all purposes in this application.

Thermoelectric assembly 90 may be mounted on door assembly 22 by using various techniques and procedures. An important requirement in mounting thermoelectric assembly 90 on door assembly 22 is to ensure that conductive plate 98 of thermoelectric device 92 and cold finger 104 are disposed adjacent to each other. In a similar manner, heat sink 100 and conductive plate 96 are preferably disposed adjacent to each other on the opposite sides of thermoelectric device 92. Various types of mounting procedures may be satisfactorily used as long as this relationship is maintained between thermoelectric device 92, cold finger 104, and heat sinks 100 and 102.

Figure 4A:
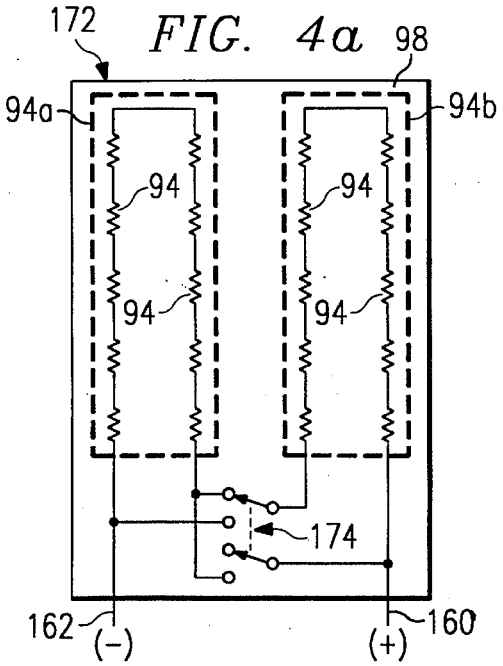
Figure 4B:
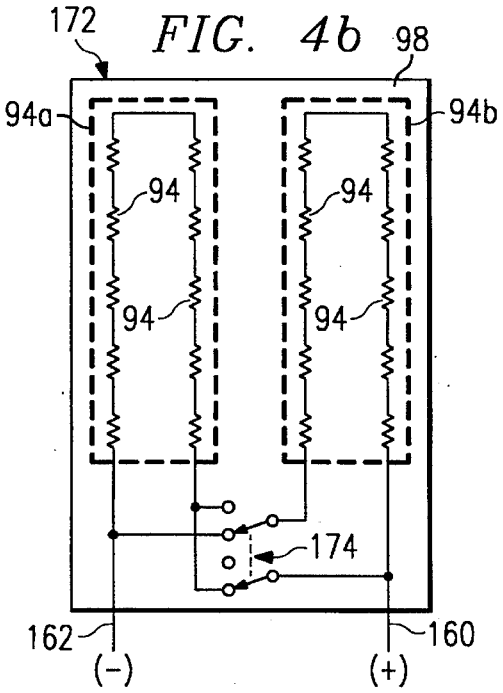

FIGS. 4*a* and 4*b* depict an electrical circuit for modifying the cooling capacity of thermoelectric device 92. As previously noted, thermoelectric elements 94 may be connected electrically in series between conductive plates 96 and 98. For some applications of the present invention, it may be desirable to increase the cooling capacity of thermoelectric device 92 during periods of high heat load and to decrease the cooling capacity of thermoelectric device 92 during periods of low heat load. Electrical circuit 172 shown in FIGS. 4*a* and 4*b* allows for modifying the cooling capacity of thermoelectric device 92. For the particular embodiment of the present invention shown in FIGS. 1–3, thermoelectric elements 94 are divided into two groups, 94*a* and 94*b*. Within each group, thermoelectric elements 94 are connected electrically in series. It is noted that the number of groups of thermoelectric elements 94 may be varied without departing from the concepts of the present invention. The groups of thermoelectric elements are connected to a power source represented by positive terminal 160 and negative terminal 162.

Electrical circuit 172 preferably includes serial parallel (S/P) switch 174 positioned electrically between group 94*a* and group 94*b*. Switch 174 may be referred to as a two position, double-pull switch. When switch 174 is in its first position as shown in FIG. 4*a*, thermoelectric element groups 94*a* and 94*b* are connected electrically in series. When switch 174 is moved to its second position shown in FIG. 4*b*, groups 94*a* and 94*b* are connected electrically in parallel.

In operation of circuit 172 of FIGS. 4*a* and 4*b*, when the maximum cooling capability from thermoelectric device 92 is required, switch 174 is placed in its second position shown in FIG. 4*b*. In this position, the thermoelectric elements in groups 94*a* and 94*b* are exposed to the full system voltage available at terminals 160 and 162. This position results in maximum current flow through the thermoelectric elements 94 in groups 94*a* and 94*b*. This maximum current flow also corresponds with the maximum heat transfer capability of thermoelectric device 92 from heat sink 102 to heat sink 100.

When the temperature within thermoelectric refrigerator 20 has reached the desired value, switch 174 may return to its first position as shown in FIG. 4*a* which connects groups 94*a* and 94*b* in series. The position of switch 174 shown in FIG. 4*a* increases the resistance between terminals 160 and 162 resulting in a substantial decrease in the current flow through thermoelectric elements 94. The lower current flow through thermoelectric elements in thermoelectric groups 94*a* and 94*b* reduces the heat transfer capability of thermoelectric device 92. This in turn, lowers the power consumption of thermoelectric refrigerator 20 providing refrigerator 20 with the technical advantage of low power operation. Refrigerator 20 may be operated in this low-power mode with switch 174 in its first position as shown in FIG. 4*a* as long as the temperature within refrigerator 20 remains at the desired operating value.

Switch 174 may be a manual switch located on the exterior of door assembly 22 or switch 174 may be an electronic switch disposed within thermoelectric device 92. It is also noted that switch 174 can be any equivalent device which can continuously convert the connection of groups of thermoelectric elements 94*a* and 94*b* from parallel to serial as previously described. By incorporating electrical circuit 172 with thermoelectric device 92, refrigerator 20 may be modified to have a high power and a low power mode responsive the temperature within enclosed structure 40.

FIG. 5 depicts another important feature of the present invention including thermal energy storage container 110 with a phase change material 112 disposed therein. Thermal energy storage container 110 may be positioned at various locations on the interior portion of door assembly 522 and/or the interior of enclosed structure 40. For thermoelectric refrigerator 520 shown in FIG. 5, thermal energy storage container 110 is located near the top of refrigerator 520 within the interior of enclosed structure 40.

Door assembly 522 has been modified to provide an alternative air flow path as compared to previously described door assembly 22 depicted in FIG. 3. Air circulating means 72 is positioned near the bottom of door assembly 522 with thermoelectric assembly 90 disposed thereabove. This arrangement results in air flow from the bottom exterior portion of door assembly 522 upwardly from impeller 80 over heat sink 100 and out through the upper exterior portion of door assembly 522. The internal air flow path within refrigerator 522 is also upwardly from impeller 82, over heat sink 102, and then out exit 114 located near the upper interior portion of door assembly 522.

Air by-pass valve 504 is preferably installed within internal cabinet 60 adjacent to thermal energy storage container 110. Air by-pass valve 504 is provided to assist in the situation where the "cold energy" of phase change material 112 has been exhausted. During normal operation of refrigerator 522, air flows upwardly from second heat sink 102, through exit 114, through energy storage container 110, and down over food or other items placed on shelves 64. Once the air reaches the bottom shelf 64, it enters plenum 366 via openings in or around bottom shelf 64. Return plenum 366 directs this air flow back to impeller 82.

During periods of continuous high heat load, such as when door assembly 522 is opened repeatedly or when excessive hot or warm food or other items are placed within internal cabinet 60, phase change material 112 may become exhausted. For an example of phase change material 112 becoming exhausted, if water is used for material 112, once all the water in the form of ice melts, the phase change from ice to water is complete, and phase change material 112 may be said to be exhausted. If material 112 is exhausted, the ability of material 112 to absorb heat within internal cabinet 60 may be compromised, and in fact, material 112 may begin to transfer heat to air being circulated through it. Therefore, it may be desirable to redirect the circulating air to bypass the material 112 until this phase within internal cabinet 60 has reached temperature within the desired temperature range. By-pass valve 504 may be provided for this purpose. By-pass valve 504 may function to selectively direct the circulating air to either fully or partially bypass thermal energy container 110 and material 112 therein. A sensor or transducer may be coupled to by-pass valve 504 to sense when phase change material 112 is exhausted, and then valve 504 may assume a second position in which the circulating air by-passes, in part or fully, container 110. Thus, air by-pass valve 504 allows cooling system 70 to directly reduce the temperature within the interior of refrigerator 520 rather than also regenerating the phase change material 112.

The sensor or transducer coupled to by-pass valve 504 may be any of numerous types of sensors or transducers. For example, the sensor may be a temperature sensor in container 110, or a sensor in container 110 for measuring the expansion/contraction of container 110, or an optical sensor in container 110 for determining the phase of material 112 based on the extent of transparency.

When the temperature within refrigerator 520 returns to the desired operating level, air bypass valve 504 may return to its first position. This allows cold air (e.g., colder than the freezing point of material 112) to flow through thermal energy storage container 110 to store "cold energy" in phase change material 112.

Various types of phase change material 112 may be satisfactorily disposed within thermal energy storage container 112 for use with the present invention. For some applications of the present invention, water may be a satisfactory phase change material. The melting point associated with water is 0° C. If this is the desired temperature for operating refrigerator 520, water may be a satisfactory phase change material 112 within thermal energy container 110.

Hydrated salt solutions may also be used to store and release the latent thermal energy associated with repeated phase changes. Any compound or mixture having the appropriate latent heat characteristics and phase change temperatures may be satisfactorily used with the invention. Such materials also include organic salts.

U.S. Pat. No. 4,609,036, entitled Bulk Heat or Cold Storage Device for Thermal Energy Storage Compounds, and U.S. Pat. No. 4,290,416, entitled Phase Change Energy Storage Panel for Environmentally Driven Heating and Cooling System provide extensive information concerning various types of hydrated phase change materials and Glauber's salt that are satisfactory for use with the present invention. For some applications, it may be desirable to use salt hydrated solutions which have the benefit of a higher melting point temperature which may correspond to the temperature to be maintained within refrigerator 520. The appropriate phase change material 112 may be selected depending on the desired operating temperature for refrigerator 520. Both of the above-referenced patents are incorporated by reference in their entirety for all purposes within this application.

FIG. 6 depicts an integrated electrical power supply and control system 200. System 200 includes AC power supply 202, DC converter 204, control unit 206 and temperature sensor 216. AC power supply 202 is coupled with switch 208 which controls the electricity provided to fan motor 74. Switch 208 also controls the electricity to door switch 210. Door switch 210 controls the electricity to interior lamp 212 and fan motor 74 when the door is opened and closed. DC converter 204 converts AC electricity from AC power supply 202 to DC electricity and supplies DC electricity to switch 214 and control unit 206.

Control unit 206 may be embodied in one or more microprocessors for use in regulating and monitoring the operation of cooling system 70 of refrigerators 20 and 520. The various functions performed by control unit 206 include, for example, controlling switch 214 to regulate the flow of electricity to thermoelectric device 92. Control unit 206 may also be used to open and close series parallel switch 174 to place thermoelectric device 92 in high and low power operating modes as previously described in connection with FIGS. 4*a* and 4*b*.

In another embodiment of control unit 206, it directly and continuously controls the power to thermoelectric device 92. In this embodiment of control unit 206, switch 174 can be eliminated as the need for switching groups of thermoelectric devices from serial to parallel connection may no longer be required.

One or more temperature or thermal sensors 216 may be placed at various locations within enclosed structure 40 and/or cooling system 70. Temperature sensor 216, coupled to control unit 206, relays refrigerator operating temperatures to control unit 206. Depending upon the desired operating temperature, control unit 206 can be used to open and close switch 174 to increase or decrease the cooling capability of thermoelectric device 92. This in turn, allows control unit 206 to implement the low and high power modes of thermoelectric device 92 as previously described in connection with FIGS. 4a and 4*b*.

In a similar manner, depending on the availability of thermal storage measured within enclosed structure 40 as measured by temperature sensor 216, control unit 206 may be used to open or close by-pass valve 504. Opening and closing by-pass valve 504 affects the cooling capability of the refrigerator as previously described in connection with FIG. 5.

Control unit 206 may also be coupled to door switch 210 which is activated when door 22 (or 522) to refrigerator 20

(or 520) is opened. Control unit 206 can respond to the opening or closing of the refrigerator's door by increasing or decreasing the current to thermoelectric device 92 by moving switch 174 appropriately. Control unit 206 may alternatively turn off fan motor 74 and suspend electricity to thermoelectric device 92 when the refrigerator's door is opened.

FIG. 7 depicts an alternate embodiment of an integrated electrical power supply and control system 300. System 300 includes AC power supply 202, DC converter 204, and temperature sensors 316, 318, and 320. AC power supply 202 is coupled with switch 208 which controls the electricity provided to fan motor 74. Door switch 210 is responsive to the opening and closing of door 22 (or 522) of refrigerator 20 (or 520) and the electricity to interior lamp 212, fan motor 74, and thermoelectric device 92.

DC converter 204 converts AC electricity from AC power supply 202 to DC electricity and supplies DC electricity to switch 314 and serial parallel switch 174.

The operation of system 300 of FIG. 7 is very similar to system 200 of FIG. 6. The various functions performed by system 300 include, for example, controlling switch 314 to regulate the flow of electricity to thermoelectric device 92. Temperature sensor 318 and switch 314 work in cooperation to cause serial parallel switch 174 to open and close to place thermoelectric device 92 in high and low power operating modes as previously described. When temperature sensor 318 senses a rise in the temperature above a predetermined level within the refrigerator to which thermoelectric device 92 has been installed, thermal sensor 318 causes serial parallel switch 174 to switch allowing high power operation of thermoelectric device 92 (FIGS. 4*a* and 4*b*.) Once the temperature in the refrigerator has reached the desired level, thermal sensor 318 will cause serial parallel switch 174 to switch back so that thermoelectric device 92 enters a low power mode of operation.

Serial parallel switch 304 and thermal sensor 320 or other sensors in system 300 cooperate to control the operation of by-pass valve 504. As described previously for FIG. 5, when the temperature within refrigerator reaches the predetermined level at temperature sensor 320, sensor 320 causes by-pass valve 504 to close directing the air flow to thermal energy storage container 110. This allows "cold energy" to be stored within container 110. Should phase change material 112 in container 110 be used up and the temperature in refrigerator 520 rise above a predetermined level, then sensor 320 can cause switch 304 to change states so that some of the cold air flow is also directed into enclosed structure 40. In this way, temperature sensor 320 controls the air flow to or away from thermal energy storage container 110.

Temperature sensor 316 can also be used to control the temperature within the refrigerator in which system 300 is contained. Temperature sensor 316 would be mounted in container 40 and when the temperature in enclosed structure 40 reached a predetermined level, temperature sensor 316 can cause switch 208 to turn off fan motor 74 and thermoelectric device 92. This would be possible because no additional cooling would be required. This allows system 300 to achieve even greater power savings. Once the temperature in enclosed structure 40 rose above the predetermined level, then temperature sensor 316 can cause switch 208 to turn on fan motor 74 so that enhanced cooling with thermoelectric device 92 is achievable.

Various types of temperature control mechanisms may be satisfactorily used as the temperature sensors of the present invention. These temperature sensors may be relatively simple thermostats having a bimetallic strip which will open electrical contacts (not explicitly shown) when the temperature of the associated heat sink reaches the desired value to block electrical flow through the associated electrical circuit. Alternatively, the temperature sensors may be relatively complex control mechanisms which monitor temperature, time and other selected parameters to allow considerable flexibility in the operation of the fan, valve, lights, and other components of the thermoelectric assembly. An example of a bimetallic thermostat which may be satisfactorily used with the present invention is designated Model J Thermal Protector available from Portage Electric Products, Inc. located at North Canton, Ohio. An example of a more complex programmable temperature sensor and controller which may be satisfactorily used with the present invention is designated CN9000A Autotune Co. available from Omega Engineering located at Stanford, Conn.

FIG. 8 depicts an additional embodiment of the present invention or enclosed structure 820. Refrigerator 820 is preferably fabricated with superinsulating materials as previously described for refrigerators 20 and 520. Also, refrigerator 820 may include a thermal energy storage container and phase change materials as previously described for refrigerator 520. The principal difference between refrigerators 20 and 520 and refrigerator 820 is represented by locating cooling system 870 on top 824 of refrigerator 820. Cooling system 870 includes heat sink 100, thermoelectric device 92 (not explicitly shown) and heat sink 102 (not explicitly shown). Air circulating means 72 may not necessarily be included as part of cooling system 870.

Although the present invention and its advantages have been described in detail, it should be understood that various changes, substitutions and alterations can be made without departing from the spirit and scope of the invention as defined by the following claims.

What is claimed is:

1. Apparatus for controlling the temperature within an enclosed structure comprising:

a thermoelectric device with a first heat sink disposed on one side of the thermoelectric device and a second heat sink disposed on the other side of the thermoelectric device;

an electrical motor mounted on the enclosed structure adjacent to the thermoelectric device;

a rotating shaft extending through the electric motor and driven by the motor with a first impeller mounted on one end of the rotating shaft for providing a first air flow and a first magnet mounted on the opposite end of the rotating shaft, the motor and the first impeller mounted on the exterior of the enclosed structure;

a second impeller for providing a second air flow mounted on the interior of the enclosed structure opposite from and aligned with the first impeller;

a second magnet attached to the second impeller and the second magnet disposed adjacent to and aligned with the first magnet;

a portion of the enclosed structure disposed between the first magnet and the second magnet with the second impeller being driven by the motor, first magnet, and second magnet; and the first impeller located adjacent to the first heat sink and the second impeller located adjacent to the second heat sink.

2. Apparatus for controlling the temperature within an enclosed structure comprising:

a thermoelectric device with a first heat sink disposed on one side of the thermoelectric device and a second heat sink disposed on the other side of the thermoelectric device;

an electrical motor mounted on the enclosed structure adjacent to the thermoelectric device;

a rotating shaft extending through the electric motor and driven by the motor with a first impeller mounted on one end of the rotating shaft for providing a first air flow and a first magnet mounted on the opposite end of the rotating shaft, the motor and the first impeller mounted on the exterior of the enclosed structure;

a second impeller for providing a second air flow mounted on the interior of the enclosed structure with a second magnet attached thereto and disposed adjacent to and aligned with the first magnet with a portion of the enclosed structure disposed between the first magnet and the second magnet, the second impeller being driven by the motor, first magnet, and second magnet;

the first impeller located adjacent to the first heat sink and the second impeller located adjacent to the second heat sink; and a plurality of thermoelectric elements, the plurality of thermoelectric elements arranged in a first group and a second group, the thermoelectric elements of the first group connected electrically in series with each other and the thermoelectric elements of the second group connected electrically in series with each other.

3. Apparatus for controlling the temperature within an enclosed structure comprising:

a thermoelectric device with a first heat sink disposed on one side of the thermoelectric device and a second heat sink disposed on the other side of the thermoelectric device;

an electrical motor mounted on the enclosed structure adjacent to the thermoelectric device;

a rotating shaft extending through the electric motor and driven by the motor with a first impeller mounted on one end of the rotating shaft for providing a first air flow and a first magnet mounted on the opposite end of the rotating shaft, the motor and the first impeller mounted on the exterior of the enclosed structure;

a second impeller for providing a second air flow mounted on the interior of the enclosed structure with a second magnet attached thereto and disposed adjacent to and aligned with the first magnet with a portion of the enclosed structure disposed between the first magnet and the second magnet, the second impeller being driven by the motor, first magnet, and second magnet;

a plurality of thermoelectric elements, the plurality of thermoelectric elements arranged in a first group and a second group, the thermoelectric elements of the first group connected electrically in series with each other and the thermoelectric elements of the second group connected electrically in series with each other; and a switch electrically connected between the first group of thermoelectric elements and the second group of thermoelectric elements, the switch having a first position which connects the first group of thermoelectric elements electrically in series with the second group of thermoelectric elements and a second position which connects the first group of thermoelectric elements electrically in parallel with the second group of thermoelectric elements.

4. The apparatus of claim 3 further comprising a control unit for moving the switch from its first position to its second position responsive to the temperature within the enclosed structure.

5. The apparatus of claim 3 wherein the switch is a manual switch disposed on the exterior of the enclosed structure for manual operation.

6. The apparatus of claim 3 further comprising a thermal sensor for sensing the temperature within the enclosed structure, the temperature sensor being further operable to move the switch responsive to the temperature within the enclosed structure.

7. Apparatus for controlling the temperature within an enclosed structure comprising:

a thermoelectric device with a first heat sink disposed on one side of the thermoelectric device and a second heat sink disposed on the other side of the thermoelectric device;

an electrical motor mounted on the enclosed structure adjacent to the thermoelectric device;

a rotating shaft extending through the electric motor and driven by the motor with a first impeller mounted on one end of the rotating shaft for providing a first air flow and the first impeller mounted on the exterior of the enclosed structure;

a second impeller for providing a second air flow mounted on the interior of the enclosed structure opposite from and aligned with the first impeller;

the first impeller located adjacent to the first heat sink and the second impeller located adjacent to the second heat sink;

the second heat sink disposed within the second air flow from the second impeller;

a container mounted on the interior of the enclosed structure comprising a medium suitable for storing thermal energy; and the container disposed within the second air flow from the second impeller.

8. Apparatus for controlling the temperature within an enclosed structure comprising:

a thermoelectric device with a first heat sink disposed on one side of the device and a second heat sink disposed on the other side of the device;

an electrical motor mounted on the enclosed structure adjacent to the thermoelectric device;

a rotating shaft extending through the electric motor and driven by the motor with an impeller mounted on one end of the rotating shaft for providing an air flow and first magnet mounted on the opposite end of the rotating shaft, the motor and impeller mounted on the exterior of the enclosed structure;

a second impeller for providing an air flow mounted on the interior of the enclosed structure with a second magnet attached thereto and disposed adjacent to the first magnet with a portion of the enclosed structure disposed between the first magnet and the second magnet, the second impeller being driven by the motor, first magnet, and second magnet;

a container mounted on the interior of the enclosed structure comprising a medium suitable for storing thermal energy; and a by-pass valve having a first position for directing air from the second impeller to the container and a second position for diverting air from the second impeller away from the container.

9. Apparatus for controlling the temperature within an enclosed structure comprising:

a thermoelectric device with a first heat sink disposed on one side of the device and a second heat sink disposed on the other side of the device;

an electrical motor mounted on the enclosed structure adjacent to the thermoelectric device;

a rotating shaft extending through the electric motor and driven by the motor with a first impeller mounted on one end of the rotating shaft for providing a first air flow, the motor and impeller mounted on the exterior of the enclosed structure;

a second impeller for providing a second air flow mounted on the interior of the enclosed structure, the second impeller being driven by the motor;

a container mounted on the interior of the enclosed structure comprising a medium suitable for storing thermal energy; and a bypass valve having a first position for directing air from the second impeller to the container and a second position for diverting air from the second impeller away from the container.

10. Apparatus for controlling the temperature within an enclosed structure comprising:

a thermoelectric device with a first heat sink disposed on one side of the device and a second heat sink disposed on the other side of the device;

an electrical motor mounted on the enclosed structure adjacent to the thermoelectric device;

a rotating shaft extending through the electric motor and driven by the motor with a first impeller mounted on one end of the rotating shaft for providing a first air flow, the motor and impeller mounted on the exterior of the enclosed structure;

a second impeller for providing a second air flow mounted on the interior of the enclosed structure;

a container mounted on the interior of the enclosed structure comprising a medium suitable for storing thermal energy; and a bypass valve having a first position for directing air from the second impeller to the container and a second position for diverting air from the second impeller away from the container.

* * * * *

UNITED STATES PATENT AND TRADEMARK OFFICE

CERTIFICATE OF CORRECTION

PATENT NO. : 5,505,046

DATED : April 9, 1996

INVENTOR(S) : Nelson, et al

It is certified that error appears in the above-identified patent and that said Letters Patent is hereby corrected as shown below:

Cover page, [21], delete "580,888" and insert -- 180,888 --.

Signed and Sealed this

Ninth Day of July, 1996

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,505,046
DATED : April 9, 1996
INVENTOR(S) : Nelson et al.

It is certified that error appears in the above-identified patent and that said Letters Patent is hereby corrected as shown below:

Column 1, lines 5-12 delete

"NOTICE

Portions of this invention were made with support of the United States Government under contract No. NAS8-5000 awarded by the National Aeronautics and Space Administration (NASA) and subcontract No. GY5509. The Government may have certain rights to the invention under the contract."

and insert

-- NOTICE

Portions of the invention described herein were made in the performance of work under National Aeronautics and Space Administration (NASA) Contract No. NASA-50000, subcontract No. GY5509 and are subject to the provisions of Section 3.05 of the National Aeronautics and Space Act of 1958 (42 U.S.C. 2457). --.

Signed and Sealed this

Twenty-fourth Day of November, 1998

*Attest:*

Bruce Lehman

BRUCE LEHMAN

*Attesting Officer*

*Commissioner of Patents and Trademarks*